US010357108B2

(12) United States Patent
Salvoni et al.

(10) Patent No.: US 10,357,108 B2
(45) Date of Patent: Jul. 23, 2019

(54) SEAT TILTING MECHANISM

(71) Applicant: Posturite Limited, Berwick (GB)

(72) Inventors: Paolo Salvoni, Castegnato (IT); Massimiliano Cernetig, Castegnato (IT)

(73) Assignee: Posturite Limited, Berwick (GB)

( * ) Notice: Subject to any disclaimer, the term of this patent is extended or adjusted under 35 U.S.C. 154(b) by 12 days.

(21) Appl. No.: 15/634,875

(22) Filed: Jun. 27, 2017

(65) Prior Publication Data

US 2017/0367484 A1 Dec. 28, 2017

(30) Foreign Application Priority Data

Jun. 28, 2016 (GB) ..... 1611215.3

(51) Int. Cl.
*A47C 1/026* (2006.01)
*A47C 1/032* (2006.01)

(52) U.S. Cl.
CPC ..... *A47C 1/03272* (2013.01); *A47C 1/03255* (2013.01)

(58) Field of Classification Search
CPC ..... A47C 1/03272; A47C 1/03255; A47C 1/03261; A47C 1/032; A47C 1/031; A47C 1/02; A47C 1/03266; A47C 1/026; A47C 7/46; A47C 7/443
USPC ..... 297/300.5, 300.2, 300.4, 285, 291–293, 297/296, 299
See application file for complete search history.

(56) References Cited

U.S. PATENT DOCUMENTS 4,410,213 A * 10/1983 Samson ..... A47C 1/032 297/319
4,411,469 A 10/1983 Drabert et al.
4,761,033 A 8/1988 Lanuzzi et al.
5,397,165 A * 3/1995 Grin ..... A47C 1/03255 297/300.5
6,709,057 B2 * 3/2004 Sander ..... A47C 1/03255 297/300.1

(Continued)

FOREIGN PATENT DOCUMENTS

EP 2 288 275 12/2009
JP H 10-127408 5/1998

(Continued)

*Primary Examiner* — Mark R Wendell
(74) *Attorney, Agent, or Firm* — Levy & Grandinetti

(57) ABSTRACT

A seat tilting mechanism comprising a main body, a seat support, a backrest support and an articulation mechanism comprising a lever, a first portion of which defines along with a first arm, the seat support and the main body a first quadrilateral hinge, and a second portion of which defines alone with a second arm, the backrest support and the main body a second quadrilateral hinge. Interior corner angles and lengths of each side of the first and second quadrilateral hinges are such that a predetermined angular displacement ratio of the backrest support in relation to the seat support is provided. An extension resistance device is mounted between the main body and the first portion to provide resistance to rotation of the lever. A first end of the extension resistance device is rotationally mounted to the lever at a first mounting point, which is located between the midpoint and upper point, and is angularly displaced from a line extending between the midpoint and the upper point.

8 Claims, 1 Drawing Sheet

(56) References Cited

U.S. PATENT DOCUMENTS

Figure 1:
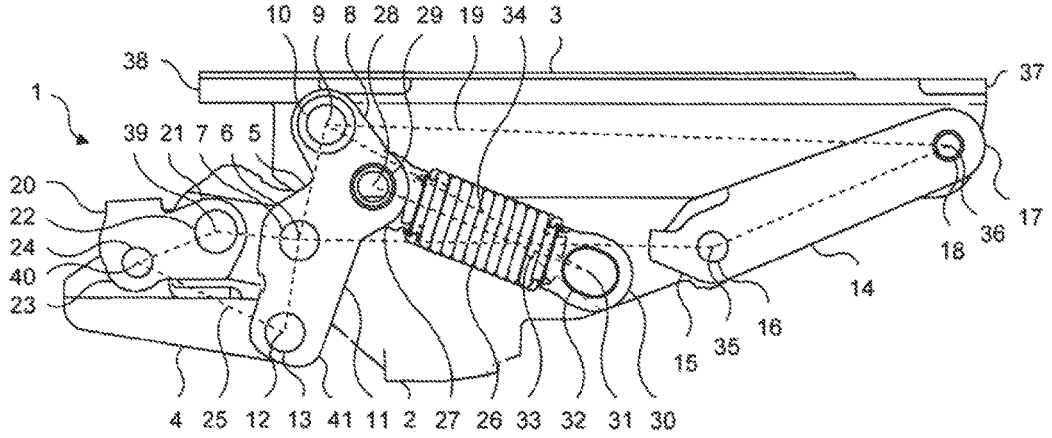

| | | | | |
|---|---|---|---|---|
| 6,817,667 | B2 * | 11/2004 | Pennington | A47C 1/023<br>297/284.4 |
| 8,646,839 | B2 * | 2/2014 | Moreschi | A47C 1/03255<br>297/300.2 |
| 2004/0026973 | A1 | 2/2004 | Sander et al. | |
| 2010/0084904 | A1 * | 4/2010 | Erker | A47C 1/03255<br>297/340 |
| 2010/0164263 | A1 | 7/2010 | Malenotti | |
| 2011/0127820 | A1 | 6/2011 | Moreschi | |
| 2017/0367485 | A1 * | 12/2017 | Salvoni | A47C 1/03272 |

FOREIGN PATENT DOCUMENTS

| | | |
|---|---|---|
| WO | WO 01/64080 | 9/2001 |
| WO | WO 2009153811 | 12/2009 |

* cited by examiner

SEAT TILTING MECHANISM

The present invention relates to a seat tilting mechanism, for use particularly, but not exclusively, with office chairs.

Office chairs and the like are commonly provided with a number of separate adjustment mechanisms. These may include mechanisms to adjust the height of the seat, the height of the backrest in relation to the seat, the lateral position of the seat in relation to the backrest, the tilt of the seat, the tilt of the backrest, and the resistance to tilting of the seat and/or the backrest.

One particular type of adjustment mechanism mechanically connects the tilt of the backrest to the tilt of the seat. The amount of angular movement of the backrest and the seat can be the same, but typically such mechanisms are configured so the backrest rotates more than the seat. As such, the further back a user tilts the backrest, the more relaxed the seating position becomes. Such mechanisms are usually provided with some kind of resistance to tilting, so they do not collapse under a user's weight. The resistance can be provided by a spring applied to the backrest, which can be suitably pre-loaded to suit users of different weights. In addition to this, it is also known to configure mechanisms of this kind so a resistance to tilting of the backrest is also provided by the weight of the user sat on the seat. A particularly effective system of this kind uses a quadrilateral hinge between the seat and a main body of the mechanism, which is configured so the seat rises as it rotates back. This means the weight of the user is continuously utilised as a resistance as the backrest rotates rearward. However, an issue with mechanisms of this kind is that the seat rises in relation to the backrest, causing so-called "shirt pull" as the user's clothing drawn downwards.

In order to address the above problems, WO2009/153811 to CO.FE.MO S.P.A., discloses an adjustment device for chairs comprising a main body, a prop element mounted above the main body for carrying a seat, a backrest mounted to the main body, and an articulation means for movably engaging the backrest and the prop element to the main body, which comprises a lever hinged to the main body at a first mounting site and having at least two lever portions hinged to the prop element at a second mounting site and to the backrest at a third mounting site respectively, so as to obtain a given movement relationship between the backrest and the prop element. A first swinging arm is hinged to the main body and to the prop element, and a second swinging arm is hinged to the main body and to the backrest. The first swinging arm defines together with the lever, the prop element and the main body a first hinged quadrilateral, and the second swinging arm defines together with the lever, the backrest and the main body a second hinged quadrilateral. Therefore, the quadrilateral hinge which controls the movement of the seat is linked to a quadrilateral hinge which controls the synchronous movement of the backrest. This allows for a more ergonomic synchronous movement of the seat and backrest which can reduce the "shirt pull" effect.

However, the device disclosed in WO2009/153811 suffers from a number of drawbacks. Firstly, the first and second quadrilateral hinges are configured such that an angular displacement ratio of the backrest in relation to the prop element is about 5 to 1. In other words, the backrest rotates five times as much as the prop element. As such, the further back the user rotates the backrest the more relaxed the seating position becomes. It has been found that an angular displacement ratio of this kind is bad for a user's back, as undue pressure is placed on the lower spine the further the angle of a user's hips opens up.

The rotation of the prop element is determined by the interior angles and lengths of each side of the first quadrilateral hinge. The first mounting site and an inner end of the first swinging arm where it is hinged to the main body are fixed, so the rotation of the prop element in relation to the main body is determined by the difference between the degree and kind of movement of the second mounting site about the first mounting site, and degree and kind of movement of an outer end of the first swinging arm about the inner end thereof.

The degree and kind of movement in each case is determined by two factors. Firstly, the distance between the second mounting site and the first mounting site, and between the outer end and the inner end of the first swinging arm respectively, will determine just how far the second mounting site and the outer end of the first swinging arm will travel when the first quadrilateral hinge is moved. Secondly, the planetary position of the second mounting site about the first mounting site, and the planetary position of the outer end of the first swinging arm about the inner end respectively, will determine whether they rise or fail, as well as how much, when first quadrilateral hinge is moved. It is the relationship between the respective positions of the second mounting site and the outer end of the first swinging arm at any position of the first quadrilateral hinge which determine the angle the prop element assumes at that moment.

The same characteristics apply to the second quadrilateral hinge, and the respective positions of the third mounting site in relation to the first mounting site, and an outer end of the second swinging arm in relation to an inner end thereof, are configured to achieved the desired angular displacement ratio of the backrest in relation to the prop element.

In WO2009/153811, in order to provide the angular displacement ratio of the backrest in relation to the prop element of 5 to 1, the angle of the second and third mounting sites about the first mounting site is about 140 degrees, and the distance between the first and second mounting site is shorter than that between the first and third mounting sites. What is achieved here is a small degree of rotation of the prop element and a large degree of rotation of the backrest. It also means that the lever is relatively compact, as it comprises a significant bend about the first mounting site.

However, if one wants to provide an angular displacement ratio of the backrest in relation to the prop element of about 2 to 1, then the angle of the second and third mounting sites about the first mounting site needs to be about 170 degrees, and the distance between the first and second mounting sites needs to be greater than in the prior art. This would create technical problems with the arrangement shown in WO2009/153811 because the resistance coil spring is mounted to the second mounting site. This is an advantageously simple construction if the lever shaped like that in WO2009/153811, but with a larger angle between the second and third mounting sites, and a greater distance between the first and second mounting sites, a correspondingly longer coil spring would be required to reach up to that point, which adds costs and complexity.

Further, mounting the resistance coil spring to the second mounting site places that hinge under undue lateral loadings. In addition, it also means that the axis of the spring is always aligned with its direction of extension. This means that the resistance provided by the spring is in accordance with its degree of extension. This may be desired in some circumstances, but it prevents a greater or lesser resistance being provided at particular points in the rotational movement of the backrest. This is disadvantageous because the weight a user places on the backrest may increase exponentially the greater the angle of tilt, and it may therefore be out of phase with a linear increase in resistance provided by the spring. As such, the rate at which the backrest rotates backwards may increase as it does so, which may not be desired.

The present invention is intended to overcome of the above problems.

Therefore, according to the present invention a seat tilting mechanism comprises a main body, a seat support, a backrest support and an articulation mechanism, in which said articulation mechanism comprises a lever rotationally mounted at a midpoint thereof to said main body, and comprising a first portion rotationally mounted at an upper point of said lever to said seat support, and a second portion rotationally mounted at a lower point of said lever to said backrest support, in which said articulation mechanism comprises a first arm, a first end of which is rotationally mounted to said main body and a second end of which is rotationally mounted to said seat support, said first arm defining with said first portion, said seat support and said main body a first quadrilateral hinge, in which said articulation mechanism comprises a second arm, a first end of which is rotationally mounted to said main body and a second end of which is rotationally mounted to said backrest support, said second arm defining with said second portion, said backrest support and said main body a second quadrilateral hinge, in which interior corner angles and lengths of each side of said first quadrilateral hinge, and interior corner angles and lengths of each side of said second quadrilateral hinge are such that a predetermined angular displacement ratio of said backrest support in relation to said seat support is provided, in which an extension resistance device is mounted between said main body and said first portion to provide resistance to rotation of said lever, in which a first end of said extension resistance device is rotationally mounted to said lever at a first mounting point located between said midpoint and said upper point, and in which said first mounting point is angularly displaced from a line extending between said midpoint and said upper point.

Thus, the present invention comprises a seat tilting mechanism similar to that shown in the prior art but in which the first end of the extension resistance device is mounted to the lever at a different location to the upper point. This allows a number of advantages over the prior art. Firstly, if it is desired to provide an angular displacement ratio of the backrest support in relation to the seat support of about 2 to 1, and as such the angle of the upper and lower points about the midpoint is about 170 degrees, the extension resistance device can be mounted below the upper point, and it can therefore be considerably shorter. Whatismore, the first mounting point can also be disposed below the level of the seat support, which makes the whole mechanism far more compact than the prior art in which the equivalent mounting point has to be level with the seat support because it is coincident with the upper point hinged thereto.

Further, as the extension resistance device is mounted to the lever at a different location to the upper point, the hinge provided at the upper point is not placed under direct lateral loadings. This may increase its operational lifespan.

In addition, with the present invention the axis of the extension resistance device misaligned with the direction of extension, because the first mounting point and the upper point are displaced from one another. As such these two points have different planetary movement paths about the midpoint, which are not aligned with one another. The first mounting point can be positioned so its planetary movement path crosses that of the upper point, and therefore aligns the axis of the extension resistance device with the direction of extension, at a desired angle of tilt of the backrest support. This can be towards the end of the rotation of the backrest support, so the resistance provided by the extension resistance device effectively increases at a greater rate than it would were its axis aligned with the direction of extension. This allows for a greater degree of compensation against the exponential increase in the weight a user places on the backrest the greater the angle of tilt. The further back the user leans the backrest, the closer the axis of the coil spring gets to the direction of extension.

In order to make this so, in a preferred construction the first quadrilateral hinge can be movable between a rest position in which the seat support can be substantially horizontal, and a fully tilted position in which the seat support can be angularly displaced from horizontal; a second end of the extension resistance device can be rotationally mounted to the main body at a second mounting point; and the first mounting point can be located such that a rotation angle between an axis of the extension resistance device and a line extending between the second mounting point and the upper point (which is effectively the direction of extension) decreases as the first quadrilateral hinge moves from the rest position towards the fully tilted position.

Preferably the first mounting point can be located such that the rotation angle is zero prior to the first quadrilateral hinge achieving the fully tilted position. This allows for the increase in resistance provided as the axis of the extension resistance device approaching the line extending between the second mounting point and the upper point to be more beneficially located in a region of tilt most used in use.

It will be appreciated that the angular displacement ratio of the backrest support in relation to the seat support can be less than one to one, such that the backrest support rotates less than the seat support, although that would not result in a seat which was comfortable to use. The ratio can also be one to one, although such a seat would then be no different to one in which the angle between the seat and backrest were fixed, but with the disadvantage of a degree of "shirt pull".

As explained above, the angle achieved by the seat support as the first quadrilateral hinge is moved is determined by the interior angles and lengths of each side of the first quadrilateral hinge. The midpoint and the second end of the first arm are fixed, so the rotation of the seat support in relation to the main body is determined by the difference between the degree and kind of movement of the upper point about the midpoint, and the degree and kind of movement of the first end of the first arm about the second end thereof. Furthermore, the angle achieved by the backrest support as the second quadrilateral hinge is moved is determined by the interior angles and lengths of each side of the second quadrilateral hinge. The midpoint and the second end of the second arm are fixed, so the rotation of the backrest support in relation to the main body is determined by the difference between the degree and kind of movement of the lower point about the midpoint, and the degree and kind of movement of the first end of the second arm about the second end thereof.

In one construction the interior corner angles and lengths of each side of the first quadrilateral hinge, and the interior corner angles and lengths of each side of the second quadrilateral hinge are such that the predetermined angular displacement ratio of the backrest support in relation to the seat support is greater than one to one. Further, it is preferably less than two to one, and in one embodiment it is substantially 1.9 to one.

The first portion h lever can be substantially L shaped, with the first mounting point located at a corner of the L shape. This is a compact and efficient arrangement.

It will be appreciated that the extension resistance device can be any known mechanism which can provide a suitable resistance to extension, including a pneumatic ram, a screw or a length of resilient material. However, in a preferred construction the extension resistance device can be an extension coil spring.

Figure 2:
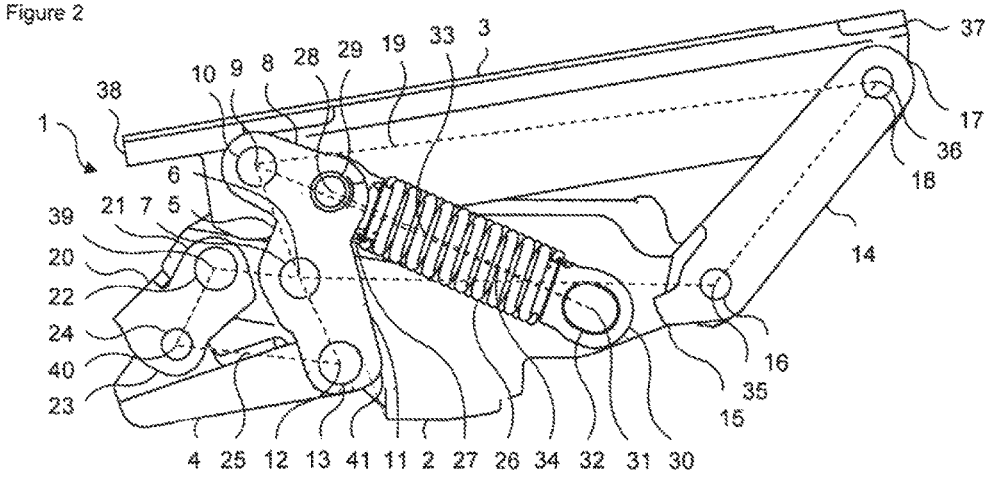

An embodiment of the present invention will now be described by example, and with reference to the accompanying drawings in which:

FIG. 1 is a side view of a seat tilting mechanism according to the present invention in a rest position; and, FIG. 2 is a side view of the seat tilting mechanism as shown in FIG. 1 in a fully tilted position.

Referring to FIG. 1, a seat tilting mechanism 1 comprises a main body 2, a seat support 3, a backrest support 4 and an articulation mechanism. The articulation mechanism comprises a lever 6 rotationally mounted at a midpoint 6 by annular hinge 7 to the main body 2, and comprising a first portion 8 rotationally mounted at an upper point 9 by annular hinge 10 to the seat support 3, and a second portion 11 rotationally mounted at a lower point 12 by annular hinge 13 to the backrest support 4.

The articulation mechanism further comprises a first arm 14, a first end 15 of which is rotationally mounted to the main body 2 by annular hinge 16, and a second end 17 of which is rotationally mounted to said seat support 3 by annular hinge 18. The first arm 14 defines with the first portion 8, the seat support 3 and the main body 2 a first quadrilateral hinge, indicated by hashed box 19. The articulation mechanism comprises a second arm 20, a first end 21 of which is rotationally mounted to the main body 2 by annular hinge 22, and a second end 23 of which is rotationally mounted to the backrest support 4 by annular hinge 24. The second arm 20 defines with the second portion 11, the backrest support 4 and the main body 2 a second quadrilateral hinge, indicated by hashed box 25.

As described further below, interior corner angles and lengths of each side of the first quadrilateral hinge 19, and interior corner angles and lengths of each side of the second quadrilateral hinge 25 are such that a predetermined angular displacement ratio of the backrest support 4 in relation to the seat support 3 is provided.

An extension resistance device, in the form of extension coil spring 26, is mounted between the main body 2 and the first portion 8 to provide resistance to rotation of the lever 5. A first end 27 of coil spring 26 is rotationally mounted to the lever 5 at a first mounting point 28 by annular hinge 29, which first mounting point 28 is located between the midpoint 6 and the upper point 9. As is clear from FIG. 1, the first mounting point 28 is angularly displaced from a line (the rightmost side of hashed box 19) extending between the midpoint 6 and the upper point 9.

The seat tilting mechanism 1 is adapted for use in an office chair, and provides a user-adjustable tilting movement thereto by virtue of being able to move between a rest position as shown in FIG. 1, in which the seat support 3 and the backrest support 4 are substantially horizontal, and a fully tilted position as shown in FIG. 2 in which the seat support 3 and the backrest support 4 are angularly displaced from horizontal. The main body 2 is adapted to rest atop an upright stanchion (not shown), the seat support 3 is adapted to support a seat (not shown) arranged generally horizontally above it, and the backrest support 4 is adapted to support a backrest (not shown) arranged generally vertically above it. The various components of the seat tilting mechanism 1 are constructed from metal. The various annular hinges are of a known construction, and allow the various components to freely rotate in relation to one another in either direction.

A second end 30 of the coil spring 26 is rotationally mounted to the main body 2 at a second mounting point 31 by annular hinge 32. In the rest position shown in FIG. 1 an axis 33 of the coil spring 26 is angularly displaced from a line 34 extending between the second mounting point 31 and the upper point 9, which is effectively the initial direction of extension which the coil spring 26 acts against. However, as will be appreciated from the Figures, the first mounting point 28 is located such that the rotation angle between the axis 33 and the line 34 decreases as the first quadrilateral hinge 19 moves from the rest position towards the fully tilted position. This is because the mounting point 28 has a different planetary movement path about the midpoint 6 to the upper point 9. The result achieved is that the increasing resistance provided by the coil spring 26 as it extends has an increasing impact on the first quadrilateral hinge 19 as it moves from the rest position as shown in FIG. 1 to the fully tilted position shown in FIG. 2. This is because the axis 33 of the coil spring 26 is brought closer and closer to the actual direction of extension. As such the resistance provided by the coil spring 6 increases as the first quadrilateral hinge 19 moves towards the fully tilted position to a greater extent that it would if axis 33 of the coil spring 26 were always aligned in the direction of extension.

This is relevant in the context of seat tilting mechanism 1 because the force which moves it is provided by the user themselves. If they place all their weight on the seat support 3, the seat tilting mechanism 1 will assume the rest position shown in FIG. 1. This is because the upper point 9 is forward of the midpoint 6, and therefore weight applied to the upper point 9 serves to force it in a clockwise direction about the midpoint 6, thereby closing the first quadrilateral hinge 19. However, once the user starts to lean back and places some of their weight on the backrest support 4, a rotational force is applied to the lower point 12 to move it in an anti-clockwise direction about the midpoint 6. This force acts to open the first quadrilateral hinge 19 against the combined tensile force of the coil spring 26 and the rest of the user's weight bearing down on the upper point 9. The rotational force applied to the lower point 12 must reach a break out point at which it exceeds the combined tensile force of the coil spring 26 and the rest of the user's weight bearing down on the upper point 9, before the first quadrilateral hinge 19 will start to open. It will be appreciated that this will vary depending on the weight of the user.

What is relevant is that as the first quadrilateral hinge 19 opens up and moves from the rest position shown in FIG. 1 towards the fully tilted position shown in FIG. 2, the rotational force applied to the lower point 12 exponentially increases because the user is being rotated backwards, so their weight gradually shifts from acting on the seat support 3 to acting on the backrest support 4. The coil spring 26 compensates for this because the force required to extend it increases with the length of extension. In addition, the user can obviously compensate for this by adjusting their body position as the seat thing mechanism 1 moves, for example by leaning forward slightly when the seat tilting mechanism 1 reaches a desired angle. However, what also applies a further degree of compensation is the above described arrangement of the coil spring 26. As the axis 33 of the coil spring 26 moves closer to the line 34 it has a greater effect. As such the resistance provided by the coil spring 26 increases with an increasing angle of tilt more than in any prior art example, which makes for a more comfortable seating experience.

As will be appreciated from FIG. 2, the first mounting point 28 is located such that the axis 33 of the coil spring 26 aligns with the line 34 prior to the first quadrilateral hinge 19 achieving the fully tilted position. As such, in FIG. 2 the axis 33 is now angularly displaced from opposite side of the line 34. What this means is that the above described increase in resistance provided as the axis 33 of the coil spring 26 approaches and then meets the line 34 is beneficially located in a region of tile more likely to be used by a user, which is prior to the fully tilted position. This makes this increase in resistance more useful.

The first quadrilateral hinge 19 comprises four corners, namely midpoint 6, upper point 9, a centre 35 of the annular hinge 16, and a centre 36 of annular hinge 18, and it moves by virtue of the annular hinges 7, 10, 16 and 18 at those corners. The lengths of each side of the first quadrilateral hinge 19 are clear from the Figures, and the interior corner angles of the first quadrilateral hinge 19 when the seat tilting mechanism 1 is in the rest position are shown in FIG. 1. These interior corner angles change as the first quadrilateral hinge 19 moves, and FIG. 2 shows them when the seat tilting mechanism 1 is in the fully tilted position.

The important characteristics of the first quadrilateral hinge 19 in the context of the present invention are firstly the greater distance between centres 35 and 36, than between midpoint 6 and upper point 9. This means that as the first quadrilateral hinge 19 moves, a front 37 of the seat support 3 rises in relation to a rear 38 thereof, and hence the seat support 3 rotates. Secondly, throughout the entire movement range of the first quadrilateral hinge 1 the centre 36 is forward of the centre 35, which means that as the first quadrilateral hinge 19 moves from the rest position shown in FIG. 1 to the fully tilted position shown in FIG. 2, the front 37 of the seat support continuously rises as the centre 36 follows its planetary path about the centre 35. Thirdly, the planetary movement path the upper point 9 follows about the midpoint as the first quadrilateral hinge 19 moves from the rest position shown in FIG. 1 to the fully tilted position shown in FIG. 2 sees it initially rise, but then fall, as it passes over centre. This means that the rear 38 of the seat support 3 initially rises slightly, but then it fails. These different movements of the centre 36 and the upper point 9, mean that the rate at which the seat support 3 rotates increases the further the first quadrilateral hinge 19 moves from the rest position to the fully tilted position. This makes for a more comfortable seating experience for the user because the angle of tilt can be more precisely controlled at first.

It will also be appreciated that the first quadrilateral hinge 1 moves from the rest position to the fully tilted position the seat support 3 moves rearwardly. This ensures that the seat and backrest parts (not shown) supported by the seat tilting mechanism 1 do not move laterally apart from one another as the user tilts the backrest back. Once again, this makes for a more comfortable seating experience.

The second quadrilateral hinge 25 comprises four corners, namely midpoint 6, lower point 12, a centre 39 of the annular hinge 22, and a centre 40 of the annular hinge 24, and it moves by virtue of the annular hinges 7, 13, 22 and 24 at those corners. The lengths of each side of the second quadrilateral hinge 25 are clear from the Figures, and the interior corner angles of the second quadrilateral hinge 25 when the seat tilting mechanism 1 is in the rest position are shown in FIG. 1. These interior corner angles change as the second quadrilateral hinge 25 moves, and FIG. 2 shows them when the seat tilting mechanism 1 is in the fully tilted position.

The second quadrilateral hinge 25 shares similar characteristics to the first quadrilateral hinge 19. It is inverted relative to the first quadrilateral hinge 19, but the spatial relationship between centres 40 and 39 is like that between centres 36 and 35, in that centre 40 is always rearward of centre 39, so it continuously falls during movement of the second quadrilateral hinge 25 from the rest position to the fully tilted position. Further, the spatial relationship between the midpoint 6 and the lower point 12 is like that between the midpoint 6 and the upper point 9, in that the lower point 12 initially falls as the second quadrilateral hinge 25 begins its movement from the rest position to the fully tilted position, but it then rises as its planetary movement path about the midpoint 6 passes over centre. As such, a front 41 of the backrest support 4 initially fails slightly, but then it rises. Once again, these different movements of the centre 40 and the lower point 12, mean that the rate at which the backrest support 4 rotates increases the further the second quadrilateral hinge 25 moves from the rest position to the fully tilted position. This works in conjunction with the similar rotation rate characteristic of the seat support 3 to make for a more comfortable seating experience for the user.

It will also be appreciated that as the second quadrilateral hinge 25 moves from the rest position to the fully tilted position the backrest support 4 moves forward. This also serves to ensure that the seat and backrest parts (not shown) supported by the seat tilting mechanism 1 do not move laterally apart from one another as the user tilts the backrest back.

However, the most important characteristic of the second quadrilateral hinge 25 in the context of the present invention is that it is configured to rotate the backrest support 4 more than the first quadrilateral hinge 13 is configured to rotate the seat support 3. The angular displacement ratio between the backrest support 4 and the seat support 3 is 1.9 to one. This is achieved because centre 39 is closer to midpoint 6 than it is to centre 40, which results in a greater angular change in the shape of the second quadrilateral hinge 25 than is achieved by the first quadrilateral hinge 25, where centre 35 is closer to centre 36 than it is to midpoint 6.

As is clear from the Figures, the first portion 8 of the lever 5 is L shaped, with the first mounting point 28 located at the corner of the L shape. This is a compact and efficient arrangement.

The seat tilting mechanism 1 operates as follows. When no user s seated on the office chair incorporating the seat tilting mechanism 1 it adopts the rest position shown in FIG. 1. This is due to the force of the coil spring 26 acting to rotate the first portion 8 of the lever 5 about the midpoint 6. The coil spring 28 comprises a sufficient tensile force to lift the backrest (not shown) back up into its generally vertical position by levering the lower point 12 clockwise about the midpoint 6.

When a user sits on the seat (not shown) mounted to the seat support 3, their weight acts to maintain the seat tilting mechanism 1 in the rest position, because the upper point 9 is forward of the midpoint 6, and therefore weight applied to the upper point 9 serves to force it in a clockwise direction about the midpoint 6, thereby closing the first quadrilateral hinge 19.

The user can lean back against the backrest (not shown) mounted to the backrest support 4 without the seat tilting mechanism 1 moving from the rest position as shown in FIG. 1, provided the force applied by the user is less than a break out point at which it exceeds the combined forces of the coil spring 26 and the rest of the user's weight bearing down on the upper point 9.

To force the office chair into a more relaxed seating position the user simply leans back against the backrest. Once the weight applied to the backrest exceeds the break out point, the first and second quadrilateral hinges 19 and 25 will start to move from the rest position to the fully tilted position. The rate at which this movement occurs will depend on the amount of force applied by the user, and they will be able to increase or decrease the rate by adjusting their body position accordingly.

As the angular displacement ratio between the seat support 3 and the backrest support 4 is 1.9 to one, the backrest will rotate more than the seat, creating a more relaxed relationship between backrest and seat the more the seat tilting mechanism 1 moves towards the fully tilted position.

Further, due to the relative positions of the upper point 9 and the lower point 12 about the midpoint 6, and in particular the fact that they initially travel upwards and downwards respectively, before travelling downwards and upwards respectively, the rate at which the seat and backrest rotate increases the further the seat tilting mechanism 1 moves towards the fully tilted position. This makes for a more comfortable seating experience.

In addition, due to the location of the first mounting point 28, the resistance to tilting increases the further the seat tilting mechanism 1 moves towards the fully tilted position, because the axis 33 of the coil spring 26 moves closer to the direction of extension. This compensates for the exponential increase in weight a user places on the backrest the further they tilt it back. Furthermore, this beneficial increase in resistance is applied in a middle region of tilt most used, which is prior to the fully tilted position.

If the user leans forward, and transfers their weight back again from the backrest to the seat, the seat tilting mechanism 1 will move back towards the rest position as shown in FIG. 1. If the user gets up from the office chair, the seat tilting mechanism 1 will return to the rest position as described above.

The seat tilting mechanism 1 shown in the figures can be used in isolation with an office chair or the like, but two can also be provided, one on either side of an office chair, to provide greater stability.

The present invention can be altered without departing from the scope of claim 1. For example in alternative embodiments (not shown) the extension resistance device is a pneumatic ram, a screw or a length of resilient material.

In further alternative embodiments (not shown) the interior corner angles and lengths of sides of the first and second quadrilateral hinges are configured to provide angular displacement ratios of the backrest support in relation to the seat support of which are different to 1.9 to one, for example 1.5 to one, two to one, three to one, four to one and five to one.

In further alternative embodiments (not shown) the seat tilting mechanism is adapted to be used with other kinds of chair, including an armchair, a garden chair and so on.

Thus, the present invention provides a seat tilting mechanism with a number of advantages over the prior art. Firstly, a more healthy angular displacement ratio of the backrest support in relation to the seat support of 1.9 to one is provided without any significant increase in the size of the mechanism. In particular, the coil spring 26 is actually shorter than in known examples. Secondly, a more user friendly and intuitive experience is provided by virtue of the increased resistance to tilt the further the seat tilting mechanism 1 is moved, and the increase in the rate of rotation the further the seat tilting mechanism 1 is moved. In combination this means that a seat to which the seat tilting mechanism 1 is applied can be moved from the rest position with less force and more precision initially. These advantageous features are provided by virtue of the location of the first mounting point 28 in relation to the upper point 9, and by the location of the upper point 9 and lower point 12 about the midpoint 6, which are all novel. Finally, the relocation of the first mounting point 28 to a dedicated site reduces the lateral loadings applied to the upper point 9 in use, which increases its operational life span.

The invention claimed is:

1. A seat tilting mechanism comprising a main body, a seat support, a backrest support and an articulation mechanism, in which said articulation mechanism comprises a lever rotationally mounted at a midpoint thereof to said main body by a first annular hinge, and comprising a first portion rotationally mounted at an upper point of said lever to said seat support by a second annular hinge, and a second portion rotationally mounted at a lower point of said lever to said backrest support by a third annular hinge, in which said articulation mechanism comprises a first arm, a first end of which is rotationally mounted to said main body and a second end of which is rotationally mounted to said seat support, said first arm defining with said first portion, said seat support and said main body a first quadrilateral hinge, in which said articulation mechanism comprises a second arm, a first end of which is rotationally mounted to said main body and a second end of which is rotationally mounted to said backrest support, said second arm defining with said second portion, said backrest support and said main body a second quadrilateral hinge, in which interior corner angles and lengths of each side of said first quadrilateral hinge, and interior corner angles and lengths of each side of said second quadrilateral hinge are such that a predetermined angular displacement ratio of said backrest support in relation to said seat support is provided, in which an extension resistance device is mounted between said main body and said first portion to provide resistance to rotation of said lever, in which a first end of said extension resistance device is rotationally mounted to said lever at a first mounting point located between said midpoint and said upper point by a fourth annular hinge, and in which said fourth annular hinge is angularly displaced from a line extending between said first annular hinge and said second annular hinge.

2. A seat tiling mechanism as claimed in claim 1 in which said first quadrilateral hinge is movable between a rest position in which said seat support is substantially horizontal, and a fully tilted position in which said seat support is angularly displaced from horizontal, in which a second end of said extension resistance device is rotationally mounted to said main body at a second mounting point, in which said first mounting point is located such that a rotation angle between an axis of said extension resistance device and a line extending between said second mounting point and said upper point decreases as the first quadrilateral hinge moves from said rest position towards said fully tilted position.

3. A seat tilting mechanism as claimed in claim 2 in which said first mounting point is located such that said rotation angle is zero prior to said first quadrilateral hinge achieving said fully tilted position.

4. A seat tiling mechanism as claimed in claim 3 in which said interior corner angles and said lengths of each side of said first quadrilateral hinge, and said interior corner angles and said lengths of each side of said second quadrilateral hinge are such that said predetermined angular displacement ratio of said backrest support in relation to said seat support is greater than one to one.

5. A seat tiling mechanism as claimed in claim 4 in which said interior corner angles and said lengths of each side of said first quadrilateral hinge, and said interior corner angles and said lengths of each side of said second quadrilateral hinge are such that said predetermined angular displacement ratio of said backrest support in relation to said seat support is less than two to one.

6. A seat tiling mechanism as claimed in claim 5 in which said interior corner angles and said lengths of each side of said first quadrilateral hinge, and said interior corner angles and said lengths of each side of said second quadrilateral hinge are such that said predetermined angular displacement ratio of said backrest support in relation to said seat support is substantially 1.9 to one.

7. A seat tiling mechanism as claimed in claim 2 in which said first portion is substantially L shaped, with said first mounting point located at a corner of said L shape.

8. A seat tiling mechanism as claimed in claim 1 in which said extension resistance device is an extension coil spring.

* * * * *